US006554876B1

(12) United States Patent
Tack et al.

(10) Patent No.: US 6,554,876 B1
(45) Date of Patent: Apr. 29, 2003

(54) OIL COMPOSITIONS

(75) Inventors: Robert Dryden Tack, Abingdon (GB); Graham A Jackson, Reading (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 09/403,060

(22) PCT Filed: Mar. 19, 1998

(86) PCT No.: PCT/EP98/01779

§ 371 (c)(1),
(2), (4) Date: Feb. 7, 2000

(87) PCT Pub. No.: WO98/46701

PCT Pub. Date: Oct. 22, 1998

(30) Foreign Application Priority Data

Apr. 11, 1997 (GB) ..... 9707367

(51) Int. Cl.[7] ..... C10L 1/18; C10L 1/22

(52) U.S. Cl. ..... 44/387; 44/388; 44/400; 44/447

(58) Field of Search ..... 44/395, 394, 400, 44/388, 387, 447

(56) References Cited

U.S. PATENT DOCUMENTS

| | | | | | |
|---|---|---|---|---|---|
| 3,444,082 | A | * | 5/1969 | Kautsky | |
| 3,658,493 | A | * | 4/1972 | Hollyday, Jr. | |
| 3,762,888 | A | * | 10/1973 | Kober et al. | |
| 3,846,093 | A | * | 11/1974 | Feldman | |
| 3,982,909 | A | * | 9/1976 | Hollyday, Jr. | |
| 4,211,534 | A | * | 7/1980 | Feldman | |
| 4,464,182 | A | * | 8/1984 | Tack et al. | 44/395 |
| 5,011,505 | A | * | 4/1991 | Lewtas et al. | 44/393 |
| 5,045,088 | A | * | 9/1991 | More et al. | 44/393 |
| 5,330,545 | A | * | 7/1994 | Lewtas et al. | 44/393 |
| 5,478,368 | A | * | 12/1995 | Lewtas et al. | 44/394 |
| 5,755,834 | A | * | 5/1998 | Chandler | 44/394 |

* cited by examiner

*Primary Examiner*—Margaret Medley

(57) ABSTRACT

Specific esters of specific alkoxylated alcohols in combination with other cold flow improvers provide oils with improved low temperature properties.

11 Claims, No Drawings

OIL COMPOSITIONS

This application is a 371 of PCT/EP98/01779 filed on Mar. 19, 1998.

This invention relates to oil compositions susceptible to the formation of wax at low temperatures, and to materials capable of improving the low temperature flow, and particularly filterability, characteristics of such oils. This invention especially relates to fuel oils especially those having narrow boiling ranges and having relatively high wax contents, and to additives for treatment thereof.

The problem of wax formation in oils is well known in the art.

In particular, lubricating and fuel oils, whether derived from petroleum or from vegetable sources, contain components that at low temperature tend to precipitate as large crystals or spherulites of wax in such a way as to form a gel structure which causes the fuel to lose its ability to flow. The lowest temperature at which the oil will still flow is known as the pour point.

As the temperature of fuel oils fall and approach the pour point, difficulties arise in transporting the fuel through lines and pumps. Further, the wax crystals tend to plug fuel lines, screens, and filters at temperatures above the pour point. These fuel problems are well recognised in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallises as platelets; certain additives, usually referred to as cold flow improves, inhibit this, causing the wax to adopt an acicular habit, the resulting needles being more likely to pass through a filter than platelets.

A further problem encountered at temperatures low enough for wax to form in a fuel is the settlement of the wax to the lower region of any storage vessel. This has two effects; one in the vessel itself where the settled layer of wax may block an outlet at the lower end, and the second in subsequent use of the fuel. The composition of the wax-rich portion of fuel will differ from that of the remainder, and will have poorer low temperature properties than that of the homogeneous fuel from which it is derived.

There are various additives available which change the nature of the wax formed, so that it remains suspended in the fuel, achieving a dispersion of waxy material throughout the depth of the fuel in the vessel, with a greater or lesser degree of uniformity depending on the effectiveness of the additive on the fuel. Such additives may be referred to as wax anti-settling additives. European Patent Application No. 0 061 895 generically describes flow improver additives for distillate fuels which are polyoxyalkylene esters, ethers, ester/ethers and mixtures thereof containing at least two $C_{10}$ to $C_{30}$ linear saturated alkyl groups and a polyoxyalkylene glycol of molecular weight 100 to 5,000, the alkyl group in said polyoxyalkylene glycol containing from 1 to 4 carbon atoms. Example 18 discloses a discrete ester of the formula:

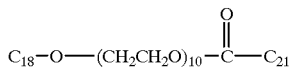

formed by the reaction of an ethoxylated $C_{18}$ linear alcohol and one mole of behenic acid. Its combination with other additives is not disclosed. Examples of polyethylene glycol dibehenate (i.e. diester) compounds are used in combination with other cold flow additives.

There exists in the art a continual need for more effective low temperature flow and filterability improvers and in particular for additives showing enhanced wax crystal modification over prior-art materials.

It has now surprisingly been found that certain esters or ethers of certain ethoxylated alcohols show surprisingly improved performance over the specific compounds disclosed in EP-A-0 061 895, when used in combination with other cold flow improvers as additives for improving the low temperature flow and filterability properties of oil systems.

In a first aspect therefore, the invention provides an additive composition comprising components (a) and (b), wherein (a) is selected from the group consisting of:

($a_1$) one or more esters obtainable by the reaction of (i) an aliphatic monocarboxylic acid having 10 to 40 carbon atoms, and (ii) an alkoxylated aliphatic monohydric alcohol wherein the alcohol has greater than 10 carbon atoms prior to alkoxylation and wherein the degree of alkoxylation is 5 to 30 moles of alkylene oxide per mole of alcohol, or ($a_2$) one or more ethers obtainable by the reaction of reactant (ii) above with (iii) an aliphatic hydrocarbon compound bearing an electrophilic group, or ($a_3$) a mixture of $a_1$ and $a_2$;

and wherein component (b) is a cold flow improver additive different from component (a).

In a second aspect, the invention provides an oil composition comprising an oil and a minor proportion of the additive composition of the first aspect of the invention.

In a third aspect, the invention provides the use of the additive composition of the first aspect of the invention to improve the low temperature properties of an oil.

The additives of the first aspect of the invention have been found to be surprisingly effective wax crystal modifying additives, in particular for fuel oils. Without being bound to any particular theory, it is thought that the degree of alkoxylation and nature of the aliphatic substituents in the ester and/or ether, in combination with the other cold flow improver, provide the excellent improvements obtained with these materials.

THE FIRST ASPECT OF THE INVENTION (ADDITIVE)

Component $a_1$

The ester may be formed from a single acid reactant (i) and single alcohol reactant (ii), or from mixtures of acids (i) or alcohols (ii) or both. In the latter cases, a mixture of ester products will be formed which may be used without separation if desired, or separated to give discrete products before use.

The acid reactant (i) preferably has 18 to 30 carbon atoms, more preferably 18 to 22 carbon atoms such as 20 or 22 carbon atoms. The acid is preferably a saturated aliphatic acid, more preferably an alkanoic acid. Alkanoic acids of 18 to 30 carbon atoms are particularly useful. n-Alkanoic acids are preferred. Such acids include behenic acid and arachidic acid, with behenic acid being preferred. Where mixtures of acids are used, it is preferred that the average number of carbon atoms in the acid mixture lies in the above-specified ranges and preferably the individual acids within the mixture will not differ by more than 8 (and more preferably 4) carbon numbers.

The alcohol reactant (ii) is preferably derived from an aliphatic monohydric alcohol having no more than 40 and preferably no more than 28 carbon atoms, and more preferably in the range of from 18 to 26 (or better no more than 24) carbon atoms, prior to alkoxylation. The range of 20 to 22 is particularly advantageous for obtaining good wax crystal modification. The aliphatic alcohol is preferably a saturated aliphatic alcohol, especially alkanol (i.e. an alkyl alcohol). Alkanols having 20 to 28 carbon atoms, and particularly 20 to 26, such as 20 to 22 carbon atoms are preferred. n-Alkanols are most preferred, particularly those having 20 to 24 carbon atoms, and preferably 20 to 22 carbon atoms.

The degree of alkoxylation of the aliphatic monohydric alcohol is preferably 10 to 25 moles of alkylene oxide per mole of alcohol, more preferably 15 to 25 moles. The alkoxylation is preferably ethoxylation, although propoxylation or butoxylation can also be used successfully. Mixed alkoxylation, for example a mixture of ethylene and propylene oxide units, may also be used.

Where the alcohol reactant (ii) is a mixture of alcohols, this mixture may comprise a single aliphatic alcohol alkoxylated to varying degrees, or a mixture of aliphatic alcohols alkoxylated to either the same or varying degrees. Where a mixture of aliphatic alcohols is used, the average carbon number prior to alkoxylation should be above 18 and preferably within the preferred ranges recited above. Preferably, the individual alcohols in the mixture should not differ by more than 4 carbon atoms.

The esterification can be conducted by normal techniques known in the art. Thus, for example one mole equivalent of the alkoxylated alcohol is esterified by one mole equivalent of acid by azeotroping in toluene at 110–120° C. in the presence of 1 weight percent of p-toluene sulphonic acid catalyst until esterification is complete, as judged by Infra-Red Spectroscopy and/or reduction of the hydroxyl and acid numbers.

The alkoxylation of the aliphatic alcohol is also conducted by well-known techniques. Thus for example a suitable alcohol is (where necessary) melted at about 70° C. and 1 wt % of potassium ethoxide in ethanol added, the mixture thereafter being stirred and heated to 1 00° C. under a nitrogen sparge until ethanol ceases to be distilled off, the mixture subsequently being heated to 150° C. to complete formation of the potassium salt. The reactor is then pressurised with alkylene oxide until the mass increases by the desired weight of alkylene oxide (calculated from the desired degree of alkoxylation). The product is finally cooled to 90° C. and the potassium neutralised (e.g. by adding an equivalent of lactic acid).

Compounds wherein the acid (i) is an alkanoic acid and the alkoxylated alcohol (ii) is formed from one mole of a $C_{20}$ to $C_{28}$ alkanol and 15 to 25 moles of ethylene oxide have been found to be particularly effective as low temperature flow and filterability improvers, giving excellent wax crystal modification. In such embodiments, the acid (i) is preferably an n-alkanoic acid having 18 to 26, such as 18 to 22 carbon atoms and the alkanol preferably has 20 to 26, more preferably 20 to 22 carbon atoms. Such a combination of structural features has been found to be particularly advantageous in providing improved wax crystal modification.

Component $a_2$

The ether is formed from the single alcohol reactant (ii) or mixture thereof previously described in relation to component $a_1$. The same preferences in chemical structure apply.

The aliphatic hydrocarbon compound (iii) bearing an electrophilic group may be an organic halide such as an alkyl, preferably n-alkyl chloride, bromide or iodide wherein the alkyl or n-alkyl group contains 10 to 40, preferably 18 to 32, such as 20 to 26 carbon atoms. Other compounds having a suitable electrophilic group, such as alkyl or n-alkyl p-toluene-sulphonate, may also be used.

The reaction between alcohol (ii) and compound (iii) is carried out following the alkoxylation of the alcohol, with the compound (iii) replacing the potassium neutralisation step described earlier.

The ester component $a_1$ is preferred as component (a) in the additive composition.

Component (b)

The cold flow additives suitable as component (b) include the following:

(I) ethylene-unsaturated ester copolymer;

(II) comb polymers;

(III) hydrocarbon polymers;

(IV) sulphur carboxy compounds;

(V) polar nitrogen compounds;

(VI) hydrocarboxylated aromatics;

These co-additives are described in more detail below.

(I) Ethylene—Unsaturated Ester Copolymer

Ethylene copolymer flow improvers e.g. ethylene unsaturated ester copolymer flow improvers, have a polymethylene backbone divided into segments by hydrocarbyl side chains interrupted by one or more oxygen atoms and/or carbonyl groups.

More especially, the copolymer may comprise an ethylene copolymer having, in addition to units derived from ethylene, units of the formula $$—CR^5R^6—CHR^7—$$

wherein $R^6$ represents hydrogen or a methyl group;

$R^5$ represents a —$OOCR^8$ or —$COOR^8$ group wherein $R^8$ represents hydrogen or a $C_1$ to $C_{28}$, preferably $C_1$ to $C_{16}$, more preferably $C_1$ to $C_9$, straight or branched chain alkyl group; and $R^7$ represents hydrogen or a —$COOR^8$ or —$OOCR^8$ group.

These may comprise a copolymer of ethylene with an ethylenically unsaturated ester, or derivatives thereof. An example is a copolymer of ethylene with an ester of an unsaturated carboxylic acid such as ethylene—acrylates (e.g. ethylene -2-ethylhexylacrylate), but the ester is preferably one of an unsaturated alcohol with a saturated carboxylic acid such asv described in GB-A-1,263,152. An ethylene-vinyl ester copolymer is advantageous; an ethylene-vinyl acetate, ethylene vinyl propionate, ethylene-vinyl hexanoate, ethylene 2-ethylhexanoate, or ethylene-vinyl octanoate copolymer or terpolymer is preferred. Neo acid vinyl esters are also useful. Preferably, the copolymers contain from 1 to 25 such as less than 25, e.g. 1 to 20, mole % of the vinyl ester, more preferably from 3 to 18 mole % vinyl ester. They may also be in the form of mixtures of two copolymers such as those described in U.S. Pat. No. 3,961,916 and EP-A-1 13,581. Preferably, number average molecular weight, as measured by vapour phase osmometry, of the copolymer is 1,000 to 10,000, more preferably 1,000 to 5,000. If desired, the copolymers may be derived from additional comonomers, e.g. they may be terpolymers or tetrapolymers or higher polymers, for example where the additional comonomer is isobutylene or diisobutylene or another ester giving rise to different units of the above formula and wherein the above-mentioned mole %'s of ester relate to total ester.

Also, the copolymers may additionally include small proportions of chain transfer agents and/or molecular weight modifiers (e.g. acetaldehyde or propionaldehyde) that may be used in the polymerisation process to make the copolymer.

The copolymers may be made by direct poiymerisation of comonomers. Such copolymers may also be made by transesterification, or by hydrolysis and re-esterification, of an ethylene unsaturated ester copolymer to give a different ethylene unsaturated ester copolymer. For example, ethylene vinyl hexanoate and ethylene vinyl octanoate copolymers may be made in this way, e.g. from an ethylene vinyl acetate copolymer. Prefered copolymers are ethylene vinyl acetate or vinyl proprionate copolymers, or ethylene vinyl 2-ethyl hexanoate or octanoate co- or terpolymers. The copolymers may, for example, have 15 or fewer, preferably 10 or fewer, more preferably 6 or fewer, most preferably 2 to 5, methyl terminating side branches per 100 methylene groups, as measured by nuclear magnetic resonance spectroscopy, other than methyl groups on a comonomer ester and other than terminal methyl groups.

The copolymers may have a polydispersity of 1 to 6 preferably 2 to 4, polydispersity being the ratio of weight average molecular weight to number average molecular weight both as measured by Gel Permeation Chromatography using polystyrene standards.

(II) Comb Polymers

Comb polymers are discussed in "Comb-Like Polymers. Structure and Properties", N. A. Platé and V. P. Shibaev, J. Poly. Sci. Macromolecular Revs., 8, p 117 to 253 (1974).

Generally, comb polymers consist of molecules in which long chain branches such as hydrocarbyl branches, optionally interrupted with one or more oxygen atoms and/or carbonyl groups, having from 6 to 30 such as 10 to 30, carbon atoms, are pendant from a polymer backbone, said branches being bonded directly or indirectly to the backbone. Examples of indirect bonding include bonding via interposed atoms or groups, which bonding can include covalent and/or electrovalent bonding such as in a salt. Generally, comb polymers are distinguished by having a minimum molar proportion of units containing such long chain branches. Advantageously, the comb polymer is a homopolymer having, or a copolymer at least 25 and preferably at least 40, more preferably at least 50, molar per cent of the units of which have, side chains containing at least 6 such as at least 8, and preferably at least 10, atoms, selected from for example carbon, nitrogen and oxygen, in a linear chain or a chain containing a small amount of branching such as a single methyl branch.

As examples of preferred comb polymers there may be mentioned those containing units of the general formula

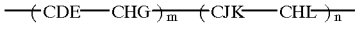

where D represents $R^{11}$, $COOR^{11}$, $OCOR^{11}$, $R^{12}COOR^{11}$ or $OR^{11}$;

E represents H, D or $R^{12}$;

G represents H or D;

J represents H, $R^{12}$, $R^{12}COOR^{11}$, or a substituted or unsubstituted aryl or heterocyclic group;

K represents H, $COOR^{12}$, $OCOR^{12}$, $OR^{12}$ or COOH;

L represents H, $R^{12}$, $COOR^{12}$, $OCOR^{12}$ or substituted or unsubstituted aryl;

$R^{11}$ representing a hydrocarbyl group having 10 or more carbon atoms, and $R^{12}$ representing a hydrocarbyl group being divalent in the $^{12}COOR^{11}$ group and otherwise being monovalent, and m and n represent mole ratios, their sum being 1 and m being finite and being up to and including 1 and n being from zero to less than 1, preferably m being within the range of from 1.0 to 0.4, n being in the range of from 0 to 0.6. $R^{11}$ advantageously represents a hydrocarbyl group with from 10 to 30 carbon atoms, preferably 10 to 24, more preferably 10 to 18. Preferably, $R^{11}$ is a linear or slightly branched alkyl group and $R^{12}$ advantageously represents a hydrocarbyl group with from 1 to 30 carbon atoms when monovalent, preferably with 6 or greater, more preferably 10 or greater, preferably up to 24, more preferably up to 18 carbon atoms. Preferably, $R^{12}$, when monovalent, is a linear or slightly branched alkyl group. When $R^{12}$ is divalent, it is preferably a methylene or ethylene group. By "slightly branched" is meant having a single methyl branch.

The comb polymer may contain units derived from other monomers if desired or required, examples being CO, vinyl acetate and ethylene. It is within the scope of the invention to include two or more different comb copolymers.

The comb polymers may, for example, be copolymers of maleic anhydride or fumaric acid and another ethylenically unsaturated monomer, e.g. an α-olefin or an unsaturated ester, for example, vinyl acetate as described in EP-A-214,786. It is preferred but not essential that equimolar amounts of the comonomers be used although molar proportions in the range of 2 to 1 and 1 to 2 are suitable. Examples of olefins that may be copolymerized with e.g. maleic anhydride, include 1-decene, 1-dodecene, 1-tetradecene, 1-hexadecene, 1-octadecene, and styrene. Other examples of comb polymer include methacrylates and acrylates.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol, 2-methyltridecan-1-ol as described in EP-A-213,879. The alcohol may be a mixture of normal and single methyl branched alcohols. It is preferred to use pure alcohols rather than alcohol mixtures such as may be commercially available; if mixtures are used the number of carbon atoms in the alkyl group is taken to be the average number of carbon atoms in the alkyl groups of the alcohol mixture; if alcohols that contain a branch at the 1 or 2 positions are used the number of carbon atoms in the alkyl group is taken to be the number in the straight chain backbone segment of the alkyl group of the alcohol.

The comb polymers may especially be fumarate or itaconate polymers and copolymers such as for example those described in European Patent Applications 153 176, 153 177, 156 577 and 225 688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{12}/C_{14}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{12}$ and $C_{14}$ alcohols. Furthermore, mixtures of the $C_{12}$ ester with the mixed $C_{12}/C_{14}$ ester may advantageously be used. In such mixtures, the ratio of $C_{12}$ to $C_{12}/C_{14}$ is advantageously in the range of from 1:1 to 4:1, preferably 2:1 to 7:2, and most preferably about 3:1, by weight. The particularly preferred fumarate comb polymers may, for example, have a number average molecular weight in the range of 1,000 to 100,000, preferably 1,000 to 50,000, as measured by Vapour Phase Osmometry (VPO).

Other suitable comb polymers are the polymers and copolymers of α-olefins and esterified copolymers of styrene and maleic anhydride, and esterified copolymers of styrene and fumaric acid as described in EP-A-282,342; mixtures of two or more comb polymers may be used in accordance with the invention and, as indicated above, such use may be advantageous.

Other examples of comb polymers are hydrocarbon polymers such as copolymers of ethylene and at least one α-olefin, preferably the α-olefin having at most 20 carbon atoms, examples being n-octene-1, iso octene-1, n-decene-1 and n-dodecene-1, n-tetradecene-1 and n-hexadecene-1 (for example, as described in W09319106). Preferably, the number average molecular weight measured by Gel Permeation Chromatography against polystyrene standards of such a copolymer is for example, up to 30,000 or up to 40,000. The hydrocarbon copolymers may be prepared by methods known in the art, for example using a Ziegler type catalyst. Such hydrocarbon polymers may for example have an isotacticity of 75% or greater.

(III) Hydrocarbon Polymers

These have one or more polymethylene backbones, optionally divided into segments by short chain length hydrocarbyl groups, i.e. of 5 or less carbon atoms.

Examples are those represented by the following general formula

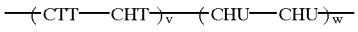

where T represents H or $R^9$;

U represents H, T or substituted or unsubstituted aryl; and $R^9$ represents a hydrocarbyl group having up to 5 carbon atoms.

and v and w represent mole ratios, v being within the range 1.0 to 0.0, w being within the range 0.0 to 1.0. Preferably, $R^9$ is a straight or branched chain alkyl group.

These polymers may be made directly from ethylenically unsaturated monomers or indirectly by hydrogenating the polymer made from monomers such as isoprene and butadiene.

Preferred hydrocarbon polymers are copolymers of ethylene and at least one α-olefin. Examples of such olefins are propylene, 1-butene, isobutene, and 2, 4, 4-trimethylpent-2-ene. The copolymer may also comprise small amounts, e.g. up to 10% by weight of other copolymerizable monomers, for example olefins other than (α-olefins, and non-conjugated dienes. The preferred copolymer is an ethylene-propylene copolymer. It is within the scope of the invention to include two or more different ethylene-α-olefin copolymers of this type.

The number average molecular weight of the ethylene-α-olefin copolymer is less than 150,000, as measured by gel permeation chromatography (GPC) relative to polystyrene standards. For some applications, it is advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000. For other applications, it is below 30,000, preferably below 15,000 such as below 10,000 or below 6,000.

Also, the copolymers may have an isotacticity of 75% or greater. Advantageously, the copolymer has a molar ethylene content between 50 and 85 per cent. More advantageously, the ethylene content is within the range of from 55 to 80%, and preferably it is in the range from 55 to 75%; more preferably from 60 to 70%, and most preferably 65 to 70%.

Examples of ethylene-α-olefin copolymers are ethylene-propylene copolymers with a molar ethylene content of from 60 to 75% and a number average molecular weight in the range 60,000 to 120,000, especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. Advantageously, the polymers are substantially amorphous, since highly crystalline polymers are relatively insoluble in fuel oil at low temperatures.

Examples of hydrocarbon polymers are described in WO-A-9 111 488. The hydrocarbon polymer may be an oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations.

Advantageously, the block copolymer before hydrogenation comprises units derived from butadiene only, or from butadiene and at least one comonomer of the formula $$CH_2{=}CR^1{-}CR^2{=}CH_2$$

wherein $R^1$ represents a $C_1$ to $C^8$ alkyl group and $R^2$ represents hydrogen or a $C_1$ to $C_8$ alkyl group. Advantageously the total number of carbon atoms in the comonomer is 5 to 8, and the comonomer is advantageously isoprene. Advantageously, the copolymer contains at least 10% by weight 5 of units derived from butadiene.

In general, the crystallizable block or blocks will be the hydrogenation product of the unit resulting from predominantly 1,4- or end-to-end polymerization of butadiene, while the non-crystallizable block or blocks will be the hydrogenation product of the unit resulting from 1,2-polymerization of butadiene or from 1,4-polymerization of an alkyl-substituted butadiene.

(IV) Sulphur Carboxy Compounds

Examples are those described in EP-A-0,261,957 which describes the use of compounds of the general formula

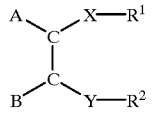

in which $-Y-R^2$ is $SO_3^{(-)(+)}NR_3{}^3R^2$, $-SO_3^{(-)(+)}HNR_2{}^3R^2$, $-SO_3^{(-)(+)}H_2NR^3R^2$, $-SO_3^{(-)(+)}H_3NR^2$, $-SO_2NR^3R^2$ or $-SO_3R^2$;

and $-X-R^1$ is $-Y-R^2$ or $-CONR^3R^1$, $-CO_2^{(-)(+)}NR_3{}^3R^1$, $-CO_2^{(-)(+)}HNR_2{}^3R^1$, $-R^4-COOR_1$, $-NR^3COR^1$, $-R^4OR^1$, $-R^4OCOR^1$, $-R^4,R^1$, $-N(COR^3)R^1$ or $Z^{(-)(+)}NR_3{}^3R^1$; $-Z^{(-)}$ is $SO_3^{(-)}$ or $-CO_2^{(-)}$;

$R^1$ and $R^2$ are alkyl, alkoxyalkyl or polyalkoxyalkyl containing at least 10 carbon atoms in the main chain;

$R^3$ is hydrocarbyl and each $R^3$ may be the same or different and $R^4$ is absent or is $C_1$ to $C_5$ alkylene and in

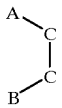

the carbon-carbon (C—C) bond is either a) ethylenically unsaturated when A and B may be alkyl, alkenyl or substituted hydrocarbyl groups or b) part of a cyclic structure which may be aromatic, polynucleai aromatic or cycloaliphatic, it is preferred that X—$R^1$ and Y—$R^2$ between them contain at least three alkyl, alkoxyalkyl or polyalkoxyalkyl groups.

Multicomponent additive systems may be used and the ratios of additives to be used will depend on the fuel to be treated.

(V) Polar Nitrogen Compounds

Such compounds comprise an oil-soluble polar nitrogen compound carrying one or more, preferably two or more, hydrocarbyl substituted amino or imino substituents, the hydrocarbyl group(s) being monovalent and containing 8 to 40 carbon atoms, which substituent or one or more of which substituents optionally being in the form of a cation derived therefrom. The oil-soluble polar nitrogen compound is either ionic or non-ionic and is capable of acting as a wax crystal growth modifier in fuels. Preferably, the hydrocarbyl group is linear or slightly linear, i.e. it may have one short length (1–4 carbon atoms) hydrocarbyl branch. When the substituent is amino, it may carry more than one said hydrocarbyl group, which may be the same or different.

The term "hydrocarbyl" refers to a group having a carbon atom directly attached to the rest of the molecule and having a hydrocarbon or predominantly hydrocarbon character. Examples include hydrocarbon groups, including aliphatic (e.g. alkyl or alkenyl), alicyclic (e.g. cycloalkyl or cycloalkenyl), aromatic, and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred.

Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulphur, and, preferably, oxygen.

More especially, the or each amino or imino substituent is bonded to a moiety via an intermediate linking group such as —CO—, —$CO_2^{(-)}$, —$SO_3^{(-)}$ or hydrocarbylene. Where the linking group is anionic, the substituent is part of a cationic group, as in an amine salt group.

When the polar nitrogen compound carries more than one amino or imino substituent, the linking groups for each substituent may be the same or different.

Suitable amino substituents are long chain $C_{12}$–$C_{40}$, preferably $C_{12}$–$C_{24}$, alkyl primary, secondary, tertiary or quaternary amino substituents.

Preferably, the amino substituent is a dialkylamino substituent, which, as indicated above, may be in the form of an amine salt thereof; tertiary and quaternary amines can form only amine salts. Said alkyl groups may be the same or different.

Examples of amino substituents include dodecylamino, tetradecylamino, cocoamino, and hydrogenated tallow amino. Examples of secondary amino substituents include dioctadecylamino and methylbehenylamino. Mixtures of amino substituents may be present such as those derived from naturally occurring amines. A preferred amino substituent is the secondary hydrogenated tallow amino substituent, the alkyl groups of which are derived from hydrogenated tallow fat and are typically composed of approximately 4% $C_{14}$, 31% $C_{16}$ and 59% $C_{18}$ n-alkyl groups by weight.

Suitable imino substituents are long chain $C_{12}$–$C_{40}$, preferably $C_{12}$–$C_{24}$, alkyl substituents.

Said moiety may be monomeric (cycylic or non-cyclic) or polymeric. When non-cyclic, it may be obtained from a cyclic precursor such as an anhydride or a spirobislactone.

The cyclic ring system may include homocyclic, heterocyclic, or fused polycyclic assemblies, or a system where two or more such cyclic assemblies are joined to one another and in which the cyclic assemblies may be the same or different. Where there are two or more such cyclic assemblies, the substituents may be on the same or different assemblies, preferably on the same assembly. Preferably, the or each cycl.ic assembly is aromatic, more preferably a benzene ring. Most preferably, the cyclic ring system is a single benzene ring when it is preferred that the substituents are in the ortho or meta positions, which benzene ring may be optionally further substituted.

The ring atoms in the cyclic assembly or assemblies are preferably carbon atoms but may for example include one or more ring N, S or O atom, in which case or cases the compound is a heterocyclic compound.

Examples of Such Polycyclic Assemblies Include (a) condensed benzene structures such as naphthalene, anthracene, phenanthrene, and pyrene;

(b) condensed ring structures where none of or not all of the rings are benzene such as azulene, indene, hydroindene, fluorene, and diphenylene oxides:

(c) rings joined "end-on" such as diphenyl;

(d) heterocyclic compounds such as quinoline, indole, 2:3 dihydroindole, benzofuran, coumarin, isocoumarin, benzothiophen, carbazole and thiodiphenylamine;

(e) non-aromatic or partially saturated ring systems such as decalin (i.e. decahydronaphthalene), a-pinene, cardinene, and bornylene; and (f) three-imensional structures such as norbornene, bicycloheptane (i.e. norbornane), bicyclooctane, and bicyclooctene.

Examples of polar nitrogen compounds are described below:

(i) an amine salt and/or amide of a mono- or polycarboxylic acid, e.g. having 1 to 4 carboxylic acid groups. It may be made, for example, by reacting at least one molar proportion of a hydrocarbyl substituted amine with a molar proportion of the acid or its anhydride.

When an amide is formed, the linking group is —CO—, and when an amine salt is formed, the linking group is —$CO_2^{(-)}$.

The moiety may be cyclic or non-cyclic. Examples of cyclic moieties are those where the acid is cyclohexane 1,2-dicarboxylic acid; cyclohexane 1,2-dicarboxylic acid; cyclopentane 1,2-dicarboxylic acid; and naphthalene dicarboxylic acid. Generally, such acids have 5 to 13 carbon atoms in the cyclic moiety. Preferred such cyclic acids are benzene dicarboxylic acids such as phthalic acid, isophthalic acid, and terephthalic acid, and benzene tetracarboxylic acids such as pyromelletic acid, phthalic acid being particularly preferred. U.S. Pat. No. 4,211,534 and EP-A-272,889 describes polar nitrogen compounds containing such moieties. The reaction product obtainable by reacting two moles of dihydrogenated tallow amine with one mole of phthalic anhydride is most preferred.

Examples of non-cyclic moieties are those when the acid is a long chain alkyl or alkylene substituted dicarboxylic acid such as a succinic acid, as described in U.S. Pat. No. 4,147,520 for example.

Other examples of non-cycilic moieties are those where the acid is a nitrogen-containing acid such as ethylene diamine tetracetic acid and nitrilotriacetic acid.

Further examples are the moieties obtained where a dialkyl spirobislactone is reacted with an amine as described in DE-A-3 926 992.

(ii) EP-A-0,261,957 describes polar nitrogen compounds according to the present description of the general formula

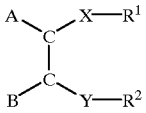

in which —Y—$R^2$ is $SO_3^{(-)(+)}NR_3{}^3R^2$, —$SO_3^{(-)(+)}HNR_2{}^3R^2$, —$SO_3^{(-)(+)}H_2NR^3R^2$, —$SO_3^{(-)(+)}H_3NR^2$, —$SO_2NR^3R^2$ or —$SO_3R^2$; and —X—$R^1$ is —Y—$R^2$ or —$CONR^3R^1$, —$CO_2^{(-)(+)}NR_3{}^3R^1$, —$CO_2^{(-)(+)}HNR_2{}^3R^1$, —$R^4$—$COOR_1$, —$NR^3COR^1$, —$R^4OR^1$, —$R^4OCOR^1$, —$R^4$,$R^1$, —$N(COR^3)R^1$ or $Z^{(-)(+)}NR_3{}^3R^1$; —$Z^{(-)}$ is $SO_3^{(-)}$ or —$CO_2^{(-)}$;

$R^1$ and $R^2$ are alkyl, alkoxyalkyl or polyalkoxyalkyl containing at least 10 carbon atoms in the main chain;

$R^3$ is hydrocarbyl and each $R^3$ may be the same or different and $R^4$ is absent or is $C_1$ to $C_5$ alkylene and in

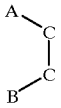

the carbon-carbon (C—C) bond is either a) ethylenically unsaturated when A and B may be alkyl, alkenyi or substituted hydrocarbyl groups or b) part of a cyclic structure which may be aromatic, polynuclear aromatic or cyclo-aliphatic, it is preferred that X—$R^1$ and Y—$R^2$ between them contain at least three alkyl, alkoxyalkyl or polyalkoxyalkyl groups.

Multicomponent additive systems may be used and the ratios of additives to be used will depend on the fuel to be treated.

(iii) EP-A-0,316,108 describes an amine or diamine salt of (a) a sulphosuccinic acid, b) an ester or diester of a sulphosuccinic acid, c) an amide or a diamide of a sulphosuccinic acid, or d) an ester-amide of a sulphosuccinic acid.

(iv) WO-A-9304148 describes a chemical compound comprising or including a cyclic ring system, the compound carrying at least two substituents of the general formula (I) below on the ring system $$—A—NR^{13}R^{14} \quad (I)$$

where A is an aliphatic hydrocarbyl group that is optionally interrupted by one or more hetero atoms and that is straight chain or branched, and $R^{13}$ and $R^{14}$ are the same or different and each is independently a hydrocarbyl group containing 9 to 40 carbon atoms optionally interrupted by one or more hetero atoms, the substituents being the same or different and the compound optionally being in the form of a salt thereof.

Preferably, A has from 1 to 20 carbon atoms and is preferably a methylene or polymethylene group.

Each hydrocarbyl group constituting $R^{13}$ and $R^{14}$ in the invention (Formula 1) may for example be an alkyl or alkylene group or a mono- or poly-alkoxyalkyl group. Preferably, each hydrocarbyl group is a straight chain alkyl group. The number of carbon atoms in each hydrocarbyl group is preferably 16 to 40, more preferably 16 to 24.

Also, it is preferred that the cyclic system is substituted with only two substituents of the general formula (I) and that A is a methylene group.

Examples of salts of the chemical compounds are the acetate and the hydrochloride.

The compounds may conveniently be made by reducing the corresponding amide which may be made by reacting a secondary amine with the appropriate acid chloride.

(v) A condensate of long chain primary or secondary amine with a carboxylic acid-containing polymer.

Specific examples include polymers such as described in GB-A-2,121,807, FR-A-2,592,387 and DE-A-3, 941,561; and also esters of telomer acid and alkanoloamines such as described in U.S. Pat. No. 4,639,256; and the reaction product of an amine containing a branched carboxylic acid ester, an epoxide and a mono-carboxylic acid polyester such as described in U.S. Pat. No. 4,631,071.

EP-0,283,292 describes amide containing polymers and EP-0,343,981 describes amine-salt containing polymers.

It should be noted that the polar nitrogen compounds may contain other functionality such as ester functionality.

(VI) Hydrocarbylated Aromatics

These material are condensates comprising aromatic and hydrocarbyl parts. The aromatic part is conveniently an aromatic hydrocarbon which may be unsubstituted or substituted with, for example, non-hydrocarbon substitutents.

Such aromatic hydrocarbon preferably contains a maximum of three substituent groups and/or two condensed rings, and is preferably naphthalene. The hydrocarbyl part is a hydrogen and carbon containing part connected to the rest of the molecule by a carbon atom. It may be saturated or unsaturated, and straight or branched, and may contain one or more hetero-atoms provided they do not substantially affect the hydrocarbyl nature of the part. Preferably the hydrocarbyl part is an alkyl part, conveniently having more than 8 carbon atoms.

The additive composition may take the form of a concentrate. Concentrates comprising the additive in admixture with a carrier liquid (e.g. as a solution or a dispersion) are convenient as a means for incorporating the additive into bulk oil such as distillate fuel, which incorporation may be done by methods known in the art. The concentrates may also contain other additives as required and preferably contain from 3 to 75 wt %, more preferably 3 to 60 wt %, most preferably 10 to 50 wt % of the additives preferably in solution in oil. Examples of carrier liquid are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; alcohols and/or esters; and paraffinic hydrocarbons such as hexane and pentane and isoparaffins. The carrier liquid must, of course, be selected having regard to its compatibility with the additive and with the oil.

The component (b) is preferably selected from the group consisting of ethylene unsaturated ester copolymers (I), polar nitrogen compounds (V), or mixtures thereof. Such combinations of additives (a) and (b) have been found to be particularly effective wax crystal modifying compositions.

The additive composition preferably comprises components (a) and (b) in a weight ratio of 1:1 to 1:20, more preferably 1:2 to 1:10. Ratios of 1:3 to 1:9 are particularly preferred. These specific ratios of components provide good wax crystal modification, particularly where component (b) is selected from group (1) and/or (V) as described above. Where (b) is an ethylene vinyl acetate copolymer, the weight ratio of a:b is preferably 1:4 and where (b) is an ethylene vinyl proprionate copolymer, the weight ratio is preferably 1:9. Where (b) is the reaction product obtainable by reacting two moles of dihydrogenated tallow amine with one mole of phthalic anhydride, the weight ratio of a:b is preferably 1:3.

The additives of the invention may be incorporated into bulk oil by other methods such as those known in the art. If co-additives are required, they may be incorporated into the bulk oil at the same time as the additives of the invention or at a different time.

The additive composition of the first aspect may also comprise other co-additives known in the art, such as detergents, antioxidants, corrosion inhibitors, dehazers, demulsifiers, metal deactivators, antifoaming agents, cetane improvers, cosolvents, package compatibilities, and lubricity additives and antistatic additives.

The Second Aspect of the Invention (oil composition)

The additive composition useful in the oil composition are those defined under the first aspect of the invention.

The oils envisaged under the second aspect are those susceptible to the formation of wax at low temperature.

The oil may be a crude oil, i.e. oil obtained directly from drilling and before refining, the compounds of this invention being suitable for use as flow improvers or dewaxing aids therein.

The oil may be a lubricating oil which may be an animal, vegetable or mineral oil, such as petroleum oil fractions ranging from naphthas or spindle oil to SAE 30, 40 or 50 lubricating oil grades, castor oil, fish oils or oxidised mineral oil. Such an oil may contain additives depending on its intended use; examples are viscosity index improvers such as ethylene-propylene copolymers, succinic acid based dispersants, metal containing dispersant additives and zinc dialkyl- dithiophosphate antiwear additives. The compounds of this invention may be suitable for use in lubricating oils as flow improvers, pour point depressants or dewaxing aids.

The oil may be fuel oil e.g. a hydrocarbon fuel such as a petroleum-based fuel oil for example kerosene or distillate fuel oil, suitably a middle distillate fuel oil, i.e. a fuel oil obtained in refining crude oil as the fraction between the lighter kerosene and jet fuels fraction and the heavier fuel oil fraction. Such distillate fuel oils generally boil within the range of about 100° C. to about 500° C., e.g. 150° to about 400° C., for example, those having a relatively high Final Boiling Point of above 360° C. ASTM-D86 Middle distillates contain a spread of hydrocarbons boiling over a temperature range, including n-alkanes which precipitate as wax as the fuel cools. They may be characterised by the temperatures at which various %'s of fuel have vaporised, e.g. 10% to 90%, being the interim temperatures at which a certain volume % of initial fuel has distilled. The difference between say 90% and 20% distillation temperature may be significant. They are also characterised by pour, cloud and CFPP points, as well as their initial boiling point (IBP) and final boiling point (FBP). The fuel oil can comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils.

The diesel fuel or heating oil may be a straight atmospheric distillate, or it may contain minor amounts, e.g. up to 35 wt %, of vacuum gas oil or cracked gas oils or of both.

Heating oils may be made of a blend of virgin distillate, e.g. gas oil, naphtha, etc. and cracked distillates, e.g. catalytic cycle stock. A representative specification for a diesel fuel includes a minimum flash point of 38° C. and a 90% distillation point between 282 and 380° C. (see ASTM Designations D-396 and D-975).

Also, the fuel oil may be an animal or vegetable oil (i.e. a 'biofuel'), or a mineral oil as described above i n c ombination with an a nimal or vegetable oil.

Biofuels, being fuels from animal or vegetable sources, are obtained from a renewable source. It has been reported that on combustion less carbon dioxide is formed than is formed by the equivalent quantity of petroleum distillate fuel, e.g. diesel fuel, and very little sulphur dioxide is formed. Certain derivatives of vegetable oil, for example rapeseed oil, e.g. those obtained by saponification and re-esterification with a monohydric alcohol, may be used as a substitute for diesel fuel. It has recently been reported that mixtures of a rapeseed ester, for example, rapeseed methyl ester (RME), with petroleum distillate fuels in ratios of, for example, 10:90 by volume are likely to be commercially available in the near future.

Thus, a biofuel is a vegetable or animal oil or both or a derivative thereof.

Vegetable oils are mainly tricylcerides of monocarboxylic acids, e.g. acids containing 10–25 carbon atoms and listed below

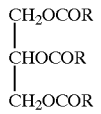

$$\begin{array}{l} CH_2OCOR \\ | \\ CHOCOR \\ | \\ CH_2OCOR \end{array}$$

where R is an aliphatic radical of 10–25 carbon atoms which may be saturated or unsaturated.

Generally, such oils contain glycerides of a number of acids, the number and kind varying with the source vegetable of the oil.

Examples of oils are rapeseed oil, coriander oil, soyabean oil, cottonseed oil, sunflower oil, castor oil, olive oil, peanut oil, maize oil, almond oil, palm kernel oil, coconut oil, mustard seed oil, beef tallow and fish oils. Rapeseed oil, which is a mixture of fatty acids partially esterified with glycerol, is preferred as it is available in large quantities and can be obtained in a simple way by pressing from rapeseed.

Examples of derivatives thereof are alkyl esters, such as methyl esters, of fatty acids of the vegetable or animal oils. Such esters can be made by transesterification.

As lower alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, margaric acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, i.e. to at least 50 wt % methyl esters of fatty acids with 16 to 22 carbon atoms and 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, castor oil, soyabean oil, cottonseed oil, peanut oil or beef tallow. Lower alkyl esters of fatty acids based on a new variety of rapeseed oil, the fatty acid component of which is derived to more than 80 wt % from unsaturated fatty acids with 18 carbon atoms, are preferred.

The concentration of the additive in the oil may for example be in the range of 1 to 5,000 ppm of additive (active ingredient) by weight per weight of fuel, for example 10 to 5,000 ppm such as 25 to 2000 ppm (active ingredient) by weight per weight of fuel, preferably 50 to 500 ppm, more preferably 200 to 400 ppm.

The additive should be soluble in the oil to the extent of at least 1000 ppm by weight per weight of oil at ambient temperature. However, at least some of the additive may come out of solution near the cloud point of the oil in order to modify the wax crystals that form.

The additives of the first aspect are particularly useful in fuel oils, such as middle distillate fuel oils, characterised as being narrow-boiling oils. Such oils are conventionally regarded as 'difficult to treat' with low temperature flow and filterability improvers. The additives of the invention are surprisingly effective wax crystal modifiers in such oils, and particularly in narrow-boiling fuel oils which also exhibit high wax contents, for example greater than 3% wax, measured at a temperature of 10 degrees celsius below oil cloud point by Differential Scanning Calorimetry (DSC). In this method, the fuel sample is cooled at a controlled rate (5° C./minute) in a DSC cell, the temperature and heat flow associated with the phase change upon n-alkane crystallisation being recorded and used to determine the amount of wax crystallising out by a specified temperature below cloud point. Narrow boiling middle distillate fuel oils may be characterised by the following distillation features (measured by ASTM D-86):

- an initial boiling point (IBP) of about 200° C., + or −50° C.;
- a final boiling point (FBP) about 340° C., + or −20° C.;
- a 90–20% distillation range of 100° C. or below, such as 70 to 100° C.; and
- a final boiling point (FBP) −90% distillation range of 30° C. or below.

High wax fuels also exhibit a relatively high wax content, for example 3 to 6% wax, especially 3 to 4% wax, as measured by the above method.

It is thought that the structural features of the specific esters and ethers of this invention interact with the compounds of such bulk fuels and wax and other cold flow improver(s) in some favourable way, so as to particularly improve the low temperature properties of these oils.

Third Aspect of the Invention (use)

The additive composition useful in the third aspect are those defined under the first aspect, and the oils suitable for such additive composition use are those described under the second aspect. Narrow-boiling middle distillate fuel oils, especially with high-wax content, are particularly suitable.

The invention will now be described further by means of the following, non-limiting examples.

EXAMPLE 1

The ester compounds shown in Table 1 were prepared according to the general method described earlier, ethylene oxide being used as the alkoxylating agent.

TABLE 1

| | Acid Reactant (i) | Ethoxylated Alochol (ii) | |
|---|---|---|---|
| Ester | (No. of carbon atoms in molecule) | No. of carbon atoms in n-alkanol | Moles of ethoxylation |
| A | Behenic acid ($C_{22}$) | $C_{22}$ | 19 |
| B | Behenic acid ($C_{22}$) | $C_{20}$ | 18 |
| C | Behenic acid ($C_{22}$) | Mixture of $C_{20}$ and $C_{22}$ | 15 |

In each entry, the alkoxylated alcohol (ii) is described in terms of its precursor materials (n-alkanol and moles of ethylene oxide units).

The wax crystal modifying effect of esters A, B and C in combination with other cold flow additives is shown in Table 2, in comparison to a dibehenate ester of polyethylene glycol (Mn of the glycol approximately 400), illustrative of the diesters disclosed in EP 0 061 895.

In Table 2 Fuel 1 was a middle distillate fuel oil having the following characteristic:

| Fuel 1 | | |
|---|---|---|
| Cloud Point: | −5° C. | |
| CFPP: | −7° C. | |
| Density: | 0.8527 | |
| ASTM D-86 | IBP | 254 |
| Distillation (° C.) | 10% | 270 |
| | 20% | 271 |
| | 50% | 283 |
| | 80% | 314 |
| | 90% | 335 |
| | 95% | 349 |

Fuel 2 had the characteristics:

| Fuel 2 | | |
|---|---|---|
| Cloud Point: | −7°C. | |
| CFPP: | −11°C. | |
| Density: | 0.8320 | |
| ASTM D-86 | IBP | 193 |
| Distillation (° C.) | 50% | 254 |
| | 90% | 338 |
| | FBP | 351 |

Each ester was added the relevant fuel in the treat rates shown in Table 2, in combination with EVA Copolymer 1, an ethylene vinyl acetate copolymer flow improver additive having an Mn (by GPC) of 3,000 and 36 wt % vinyl acetate, or polar nitrogen 1, a N,N-dialkylammonium salt of 2-N', N'-dialkyl-amidobenzoate being the reaction product of reacting one mole of phthalic anhydride with two motes of dihydrogenated tallow amine to form a half amidelhalf amine salt. The CFPP test which is carried out by the procedure described in detail in "Journal of the Institute of Petroleum", Volume 52, Number 510, June 1966, pp. 173–285, is designed to correlate with the cold flow of a middle distillate in automotive diesels.

In brief, a sample of the oil to be tested (40 ml) is cooled in a bath which is maintained at about −34° C. to give non-linear cooling at about 1° C./min. Periodically (at each one degree centigrade starting from above the cloud point), the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 millimetre diameter. The periodic tests are each initiated by applying a vacuum to the upper end of the pipette whereby oil is drawn through the screen up into the pipette to a mark indicating 20 ml of oil. After each successful passage, the oil is returned immediately to the CFPP tube. The test is repeated with each one degree drop in temperature until the oil fails to fill the pipette within 60 seconds, the temperature at which failure occurs being reported as the CFPP temperature.

TABLE 2

| | Additive Composition | | Ratio of a:b | | CFPP Result at Total Additive Treat Rate Shown | | | |
|---|---|---|---|---|---|---|---|---|
| | | | | | 100 ppm | 200 ppm | 300 ppm | 400 ppm |
| Experiment | Component (a) | Component (b) | (wt:wt, ai) | Fuel | ai | ai | ai | ai |
| 1 | Ester A | EVA Copolymer 1 | 1:4 | 1 | −11 | −15 | −19 | −18 |
| 2 | Ester B | EVA Copolymer 1 | 1:4 | 1 | −10 | −15 | −18 | −20 |
| 3 | PEG 400 dibehenate (Comp.) | EVA Copolymer 1 | 1:4 | 1 | −8 | −9 | −17 | — |
| 4 | Ester A | EVA Copolymer 1 | 1:9 | 2 | −15 | −17 | −22 | −30 |
| 5 | Ester C | EVA Copolymer 1 | 1:9 | 2 | — | −16 | −22 | — |
| 6 | PEG 400 dibehenate (Comp.) | EVA Copolymer 1 | 1:9 | 2 | −14 | −17 | −18 | −23 |
| 7 | Ester A | Polar nitrogen 1 | 1:3 | 1 | −10 | −11 | −14 | −16 |
| 8 | Ester C | Polar nitrogen 1 | 1:3 | 1 | −8 | −9 | −17 | −16 |
| 9 | PEG 400 dibehenate (Comp.) | Polar nitrogen 1 | 1:3 | 1 | −5 | −5 | −8 | −11 |

The combination of ester A, B or C and Co-additive surprisingly gave CFPP results superior to those obtained with the PEG 400 dibehenate comparative example, illustrating the advantageous properties of the additives of the invention.

What is claimed is:

1. A fuel oil composition comprising a narrow boiling middle distillate fuel oil and 1–5,000 ppm of an additive composition comprising components (a) and (b), wherein (a) is selected from the group consisting of:

one or more esters obtainable by the reaction of (i) an aliphatic monocarboxylic acid having 18 to 30 carbon atoms, and (ii) an alkoxylated aliphatic monohydric alcohol wherein the alcohol has 18 to 26 carbon atoms prior to alkoxylation and wherein the degree of alkoxylation is 15 to 25 moles of alkylene oxide per mole of alcohol, wherein the alkylene oxide is ethylene, propylene, or butylene oxide;

and wherein component (b) is a cold flow improver additive different from component (a), and is selected from the group consisting of ethylene-unsaturated ester copolymers, comb polymers, hydrocarbon polymers, sulphur carboxy compound, polar nitrogen compounds and hydrocarbylated aromatic condensates.

2. The composition of claim 1 wherein component (b) is selected from the group consisting of ethylene unsaturated ester copolymers, polar organic nitrogen compounds, and mixtures thereof.

3. The composition according to claim 1 wherein the weight ratio of (a):(b) is in the range of 1:1 to 1:20.

4. The composition of claim 1, wherein (a) is obtainable by the reaction of:

(i) behenic acid, and (ii) the alkoxylated alcohol formed from the mole on an n-$C_{20}$ or n-$C_{22}$ alkanol, or mixture thereof, and 15 to 25 moles of ethylene oxide.

5. The composition of claim 1, wherein the alkoxylated alcohol (ii) is an ethoxylated alcohol.

6. The composition of claim 1, wherein the alcohol prior to alkoxylation is an alkanol.

7. The composition of claim 1, wherein the weight ratio of (a):(b) is 1:4 and component (b) is ethylene vinyl acetate copolymer.

8. The composition of claim 6, wherein the alkanol is an n-alkanol having 20 to 24 carbons.

9. The composition of claim 1, wherein the weight ratio of (a):(b) is 1:9 and component (b) is an ethylene-vinyl propionate copolymer.

10. The composition of claim 1, wherein component (b) is the reaction product obtainable by reacting two moles of dihydrogenated tallow amine with one mole of phthalic anhydride.

11. The composition of claim 9, wherein the weight ratio of (a):(b) is 1:3.

* * * * *